United States Patent [19]

Petersen et al.

[11] 4,295,847

[45] Oct. 20, 1981

[54] FINISHING PROCESS FOR TEXTILES

[75] Inventors: Harro Petersen, Frankenthal, Fed. Rep. of Germany; Panemangalore S. Pai; Manfred Reichert, both of Charlotte, N.C.

[73] Assignee: BASF Aktiengesellschaft, Fed. Rep. of Germany

[21] Appl. No.: 115,264

[22] Filed: Jan. 25, 1980

[51] Int. Cl.[3] ..... D06M 13/38; D06M 15/38; D06M 15/54; D06M 1/02

[52] U.S. Cl. ..... 8/189; 8/186; 8/125; 427/324; 427/393.2

[58] Field of Search ..... 427/324, 393.2; 8/185, 8/186, 189, 94.33, 125

[56] References Cited

U.S. PATENT DOCUMENTS

| | | | |
|---|---|---|---|
| 1,065,514 | 6/1913 | Evans . | |
| 1,998,551 | 4/1935 | Mahn . | |
| 3,406,006 | 10/1968 | Lindberg et al. . | |
| 3,502,672 | 3/1970 | Petersen et al. | 8/189 X |
| 3,518,043 | 6/1970 | Petersen et al. | 8/189 |
| 3,560,140 | 2/1971 | Gailey | 8/125 |
| 3,582,257 | 6/1971 | Hirshfeld et al. | 8/189 X |
| 3,597,147 | 8/1971 | Bille et al. | 8/189 X |

FOREIGN PATENT DOCUMENTS

| | | |
|---|---|---|
| 1469269 | 12/1968 | Fed. Rep. of Germany . |
| 2006516 | 8/1971 | Fed. Rep. of Germany . |
| 2523433 | 12/1975 | Fed. Rep. of Germany . |

OTHER PUBLICATIONS

J. Müller, Chemiefasern und Textilindustrie 25 (1975), No. 5, pp. 449–450.

K. Bredereck, Textilveredelung 13 (1978), No. 12, pp. 498–506.

*Primary Examiner*—Michael R. Lusignan

*Attorney, Agent, or Firm*—Keil & Witherspoon

[57] ABSTRACT

Process for finishing textiles of natural or regenerated cellulose, which have been pretreated with liquid ammonia, wherein the finishing agent used is an N-monomethylol compound or N-monoalkoxymethyl compound of 4-hydroxy- or 4-alkoxy-5,5-dimethylpropyleneurea. The process couples a high degree of finishing effect (in respect of improvement of the shrink resistance and wrinkle resistance) with only a very slight effect on the hand and especially on the tensile strength.

2 Claims, No Drawings

FINISHING PROCESS FOR TEXTILES

For the purposes of the invention, finishing means wrinkle-resist and shrink-resist finishing, also referred to as easy-care finishing. This finishing is carried out with aminoplast intermediates, ie. compounds which contain N-methylolated amide groups, especially methylolated urea and its derivatives, methylolated melamine and methylolated carbamates. On curing or fixing, the N-methylol groups react, under the influence of heat and catalysts, with the hydroxyl groups of the cellulose, with acetal formation and crosslinking. Normally, a substantial drop in the mechanical strength of the cellulose resulting from this treatment is hardly avoidable. For example, decreases in tear strength of the order of magnitude of 30–40% or even more are common. This is a serious disadvantage of textile finishing, whilst on the other hand such finishing is essential to meet present-day requirements for shrink resistance and wrinkle resistance. Of course, this disadvantage is particularly severe in the case of purely cellulosic textiles, ie. woven fabrics and knitted fabrics which consist exclusively of natural or regenerated cellulose, in particular exclusively of cotton, linen, rayon or staple viscose, since in such fabrics the strength cannot rely on the added presence of synthetic fibers. In general, a further disadvantage, which applies not only to purely cellulosic textiles, is a more or less objectionable hardening of the hand of the textile.

There have been many attempts to solve these problems. For example, German Pat. No. 1,469,269 and U.S. Pat. No. 3,502,672 propose doubly methylolated cyclic ureas of the formula I

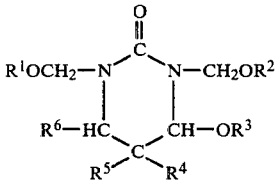

I where $R^1$ to $R^6$ are hydrogen or low molecular weight alkyl, as textile finishing agents. It is true that these compounds have certain advantages (for example in respect of resistance to hydrolysis, lightfastness of dyeings, and fastness to chlorine), but the use of these compounds does not satisfactorily solve the two problems mentioned, in respect of mechanical strength and hand.

Finishing agents based on compounds of the formula II

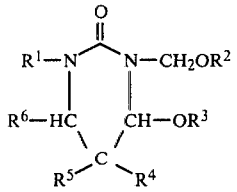

II where $R^1$ is alkyl of 1 to 18 carbon atoms, $R^2$, $R^3$ and $R^6$ are hydrogen or low molecular weight alkyl and $R^4$ and $R^5$ are low molecular weight alkyl have also been proposed, cf. German Laid-Open Application DOS 2,006,516. Whilst these compounds make it possible substantially to overcome the two problems mentioned, the finishes achievable with them have nevertheless proved inadequate in practice.

A possible way of increasing the mechanical strength (in addition to other important properties, such as gloss and smoothness) of cellulosic textiles comprises mercerizing or alkalizing, ie. a treatment with a concentrated hot caustic alkali with or without mechanical treatment. An embodiment of this long-established process which has recently found increasing acceptance in practice, especially in the USA, comprises replacing the caustic alkali by liquid ammonia (cf., for example, U.S. Pat. Nos. 1,998,551, 3,406,006, 3,560,140 and 1,065,514, German Laid-Open Application DOS 2,523,433, J. Müller, Chemiefasern und Textilindustrie 25 (1975), No. 5, 449–450, and K. Bredereck, Textilveredelung 13 (1978), No. 12, 498–506). At the present time, the most important process of this type is the SANFOR-SET process of the Sanforized Company, USA. Using this process it is for example possible to increase the tear strength of cellulosic textiles by an amount of the order of 10–15%. This however, does not suffice to compensate the tear strength losses during subsequent easy-care finishing, which are of the order of magnitude of 40%, to an extent that the final tear strength suffices.

It is an object of the present invention to provide a process for finishing cellulosic textiles which have been pretreated with liquid ammonia, which couples a high degree of finishing effect (in respect of improvement of the shrink resistance and wrinkle resistance) with only a very slight effect on the hand and especially on the tensile strength.

We have found that this object is substantially achieved by employing the process defined in the claim. Satisfactory Monsanto ratings, dry wrinkle recovery angle and wet wrinkle recovery angle, and low shrinkage values are achieved without being accompanied by substantial losses in strength compared to the strength prior to the ammonia treatment. The overall properties of the textiles finished in accordance with the invention are more advantageous than those achieved with finishes produced by conventional processes.

The compounds of formula III (shown in the claim) can be prepared by reacting urea with isobutyraldehyde and formaldehyde in the molar ratio of 1:1:1 in aqueous solution, or in an alcohol of the formula $R^2OH$, and in the presence of a non-oxidizing inorganic acid, at from 30° to 120° C., followed by reaction with 1 mole of formaldehyde under alkaline conditions. The resulting monomethylol compound can be etherified with an alcohol $R^1OH$ in an acid medium. As is clear from the meaning of $R^2$ in formula III, the alcohol $R^2OH$ may also be a glycol of the formula

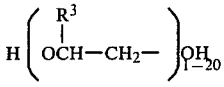

where $R^3$ is hydrogen or methyl. $R^3$=methyl is however a less preferred meaning than $R^3$=hydrogen or a mixture of hydrogen and methyl. In particular, $R^3$ should not be exclusively methyl if $R^1$ is propyl, since otherwise the molecule as a whole becomes insufficiently watersoluble, and adequate solubility in water of the compounds of the formula III is of course a precondition of their usefulness.

The synthesis thus takes place similarly to the conventional synthesis of the compounds of the formula I, but with correspondingly less formaldehyde, so that only the monomethylol compound is formed. As shown by nuclear resonance spectral analysis, methylolation with one mole of formaldehyde results almost exclusively in the 1-monomethylol compound, with only minor amounts of the 2-monomethylol compound and/or the 1,3-dimethylol compound, in addition to non-methylolated starting compound. For the purposes of the invention, compounds of the formula III means the actual reaction mixture, containing an average of one methylol group per molecule. As stated, this definition corresponds substantially, but not 100%, to formula III, but is intended to apply even in the (improbable) event that formula III should at a later date prove to be incorrect.

Examples of compounds of the formula III obtainable as described above are N-monoethoxymethyl-4-ethoxy-5,5-dimethylpropyleneurea, N-monomethoxyethoxymethyl-4-methoxyethoxy-5,5-dimethylpropyleneurea, N-monomethylol-4-hydroxy-5,5-dimethyl-propyleneurea (IV), N-monomethylol-4-methoxy-5,5-dimethyl-propyleneurea (V) and N-monomethoxymethyl-4-methoxy-5,5-dimethylpropyleneurea (VI), the last three being preferred because of being readily obtainable.

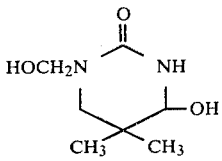

(IV)

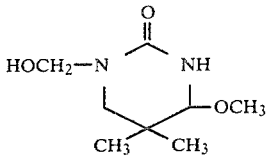

(V)

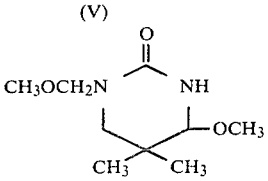

(VI)

The finishing agents of the formula III are marketed as 40–60% strength aqueous solutions or dispersions and, for use, are diluted with water. They have proved particularly effective on cellulosic textiles which have been pretreated with ammonia. The compounds may be used by the conventional processes for applying N-methylol compounds to textiles. In these processes, the goods to be finished are impregnated with an aqueous solution or dispersion of the finishing agent and an acid or latent acid catalyst and are reacted with the finishing agent as described at the outset. This reaction (fixing or curing) can be carried out on the wet textiles; alternatively, the textile may, between impregnation and chemical reaction, be partially or completely dried and, if desired, be kept for a lengthy period and/or made into garments in its impregnated but as yet unreacted, or incompletely reacted, state.

The concentration of the compounds of the formula III in the finishing liquor is in general from 40 to 200 g/l. Preferably, the impregnation is carried out on a padder. The impregnated textile is freed from excess impregnating liquid by squeezing off, in a conventional manner. The amount of the compound of the formula III applied to the fibers should be from 50 to 100, preferably from 60 to 70, % by weight, based on the textile to be finished.

To effect fixing, the impregnated fibrous material is heated, in the presence of an acid or latent acid catalyst, at from 110° to 230° C., preferably from 120° to 210° C. In general, the reaction is complete in from 10 seconds to 6 minutes, preferably from 20 seconds to 2 minutes, under these conditions.

Acid or latent acid catalysts for finishes of N-methylol compounds or N-alkoxymethyl compounds have been disclosed and are commonly used. Examples of these, which are also applicable to the process according to the invention, are inorganic and organic acids, eg. sulfuric acid, hydrochloric acid, phosphoric acid, boric acid and oxalic acid, and salts which have an acid reaction or which form acids, for example through hydrolysis, during use, eg. ammonium salts of strong acids, magnesium chloride, zinc chloride and zinc nitrate. It is often advantageous to use mixtures of several catalysts. As mentioned, the reaction of the compounds of the formula III with the textile is carried out in the presence of these catalysts. This can be achieved by applying the catalyst, preferably in the form of an aqueous solution, onto the textile to be finished, before or after the latter has been impregnated with the novel compounds. Preferably, however, the catalyst is introduced directly into the impregnating liquor containing the compounds of the formula III. In general, catalyst concentrations from 1 to 40 g/l have proved suitable for the finishing process.

The conventional water-repellents, softening, leveling and wetting agents, and resin finishes, can be used together with the novel finishing agents according to the invention. Examples of water-repellants are aluminum-containing or zirconium-containing paraffin wax emulsions, and silicone-containing formulations. Examples of softeners are oxyethylation products of higher fatty acids, fatty alcohols or fatty acid amides, relatively high molecular weight polyglycol ethers, higher fatty acids, fatty alcohol-sulfonates, N-stearyl-urea compounds and stearylamidomethylpyridinium chloride. Examples of suitable leveling agents are water-soluble salts of acidic esters obtained from polybasic acids and ethylene oxide or propylene oxide adducts of relatively long-chain base molecules capable of undergoing oxyalkylation. Examples of wetting agents are salts of alkylnaphthalenesulfonic acids, the alkali metal salts of dioctyl sulfosuccinate, and the adducts of alkylene oxides with fatty alcohols, alkylphenols, fatty amines and the like. Examples of resin finishes are cellulose ethers, cellulose esters and alginates, as well as solutions or dispersions of synthetic polymers and polycondensates, eg. of polyethylene, nylons, oxyethylated nylons, polyvinyl ethers, polyvinyl alcohols, polyacrylic acid, polyacrylates and polyacrylamides, the corresponding polymethacrylic compounds, polyvinyl propionate, polyvinylpyrrolidone, and copolymers, for example of vinyl chloride and acrylic acid esters, of butadiene and styrene or acrylonitrile, or of 1,1-dichloroethylene, β-chloroalkyl acrylates or vinyl ethyl ether and acrylamide, crotonamide or maleamide, or of N-methylolmethacrylamide and other polymerizable compounds. These additional assistants are in general used in amounts of from 0.3 to 4%, preferably from 1 to 2.5%, based on the weight of the dry textile, though in special cases these amounts can also be exceeded.

On an ammonia-pretreated cellulosic textile, the process according to the invention produces a finish which provides satisfactory shrink resistance and wrinkle resistance coupled with high stability to chlorine, does not substantially influence the textile hand, and gives a level of hydrolysis resistance adequate for practical use, whilst causing a decrease in tensile strength, relative to the strength of the ammonia-pretreated textile, which rarely exceeds 20%. Further advantageous properties are revealed by the Examples.

The following Examples are illustrative of the present invention and are not to be considered as limiting. Unless otherwise stated, the percentages are based on the weight of the bath.

EXAMPLE 1

The following aqueous solutions were prepared using, as "Textile Resin", a compound of formula III where $R^1$ represents hydrogen and $R^2$ represents an approximately equimolar mixture of hydrogen and methyl. This compound had been prepared by the following procedure:

A mixture of 1070 parts of methanol, 500 parts of urea, 625 parts of a 40% solution of formaldehyde and 40 parts of a 50% solution of caustic soda is stirred for one hour at 50° C. in a stirred kettle. After pH adjustment to pH 5.0 with a 75% sulfuric acid, 670 parts of isobutyraldehyde are added with cooling. The mixture is stirred for 30 minutes at 50° C. An amount of 300 parts of sulfuric acid (75%) is added with cooling and the mixture is refluxed at 80° to 85° C. for eight hours. After cooling, the pH is adjusted to 7.0 with caustic soda. The precipitated sodium sulfate is filtered off and the solution is vacuum evaporated at 60° C. The yield of 1350 parts of 5,5-dimethyl-4-methoxy-propyleneurea is mixed with 625 parts of a 40% solution of formaldehyde and 20 parts of a 50% solution of caustic soda. After stirring the reactants for two hours at 50° C. (pH approx. 10.5), the pH is adjusted to 7.0 with sulfuric acid (75%). To the mixture is added an amount of 1100 parts of water to produce a solution with a solids content of 50%.

TABLE 1

| No. | Textile Resin (48% Aqueous Sol.) | Non-ionic Wetting Agent+ | Catalyst++ | Curing Temperature [°C.] | Curing Time [sec] |
|---|---|---|---|---|---|
| 1 | 10% | 0.1% | 1.0% | 180 | 110 |
| 2 | 30% | 0.1% | 4.2% | 170 | 80 |
| 3 | 15% | 0.1% | 2.7% | 160 | 110 |
| 4 | 25% | 0.1% | 4.5% | 150 | 100 |

+p-Octylphenol oxyethylated with 5 to 6 moles of ethylene oxide.
++The catalyst consisted of a 35.5% aqueous solution of magnesium nitrate hexahydrate additionally containing 4.6%, based on the weight of the solution, of citric acid.

100% cotton broadcloth Sanfor-set shirting fabric swatches were prepared, each switch being 35×50 cm. Solutions Nos. 1 to 4, prepared according to Table 1, were padded onto three swatches of cloth in each pad bath to a wet pickup of 65% at room temperature, dried at 107° C. for 1 minute and cured for the period and at the temperature shown in Table 1. The fabrics thus dried and cured were then tested in accordance with standard test methods. The test results are shown in Table 2.

TABLE 2

| Pad Bath | Dry Crease Recovery AATCC Test Method 66-1975 (Warp + Fill) | Durable Press Rating After 5 Home Launderings AATCC Test Method 124-1975 | % Shrinkage (Warp × Fill) After 5 Home Launderings AATCC Test Method 135-1973 | Tensile Strength Fill - ASTM D 1682-64 (1975) [kg] |
|---|---|---|---|---|
| 1 | 241° | 3.0 | (2.5 × 2.6) | 21 |
| 2 | 251° | 3.0 | (1.2 × 1.9) | 19.5 |
| 3 | 259° | 3.0 | (1.9 × 1.7) | 19.5 |
| 4 | 262° | 3.5 | (1.6 × 1.7) | 20 |
| Control not finished | 198° | 1.5 | (7.5 × 4.5) | 25 |

From the above Example it is clear that finishing with the crosslinking agent of the invention gives good dry crease angle recovery, good Durable Press appearance and better shrinkage control than the untreated control cotton fabric. Most importantly, minimum tensile strength losses have been observed in a finishing process where curing temperatures have been varied between 150° and 180° C.

The following further textile properties were tested:

(1) Determination of formaldehyde odor in the finished fabric by the Sealed Jar Method as described in AATCC Test Method 112-1975.

(2) Abrasion resistance of fabrics: Accelerator Method—AATCC Test Method 93-1974.

The test data are shown in Table 3.

TABLE 3

| Pad Bath No. | Fabric Free Formaldehyde Content [ppm] | Accelerotor Abrasion Loss [in %] |
|---|---|---|
| 1 | 421 | 3.6 |
| 2 | 1009 | 5.1 |
| 3 | 724 | 6.3 |
| 4 | 1301 | 6.5 |

From the above Example it is clear that finishing with the Textile Resins gives an acceptable formaldehyde odor level (near or under 1000 ppm) as required by the garment industry, and also provides a low abrasion loss at different temperatures of curing.

EXAMPLE 2

A pad bath formulation is prepared from the following ingredients:

14.0% of the Textile Resin solution of Example 1,
0.2% of the non-ionic wetting agent of Example 1,
1.9% of the catalyst solution of Example 1, and
1.0% of a commercial non-ionic polyethylene emulsion (25% solids),
the balance being water.

The above was padded onto 100% cotton (Sanfor-set) broadcloth shirting fabric at 65 to 70% wet pick-up from the bath. The fabric was then dried at 107° C. for 60 seconds in a tenter frame. The so dried fabric was cured at various temperatures for 90 seconds in the tenter frame as shown in Table 4. The fabrics were again tested by the standard AATCC Test Methods, especially for the Durable Press appearance, Shrinkage (Warp×Fill) and Tensile Strength losses due to the potential damage caused by chlorine bleaching. The evaluation data are shown in Table 4.

TABLE 4

| No. | Curing Temp. [°C.] | Durable Press Appearance 1 Home Wash | % Shrinkage (W × F) 1 Home Wash | Chlorine Retention Damage (After 1 Wash) +Before Scorching Warp Tensile (kg) | +After Scorching Warp Tensile (kg) | Loss/Gain Tensile |
|---|---|---|---|---|---|---|
| 1 | 120 | 2.8 | 1.5 × 1.5 | 19.67 | 19.68 | +0.05% |
| 2 | 126 | 3.0 | 1.5 × 0.95 | 19.78 | 19.86 | +0.41% |
| 3 | 132 | 3.2 | 1.3 × 0.95 | 19.11 | 19.52 | +2.13% |
| 4 | 138 | 3.4 | 1.0 × 0.65 | 19.01 | 18.85 | −0.81% |
| 5 | 144 | 3.2 | 1.1 × 1.0 | 18.13 | 19.51 | +7.65% |
| 6 | 150 | 3.3 | 1.0 × 0.9 | 18.36 | 18.24 | −0.64% |
| 7 | 155 | 3.3 | 1.0 × 0.7 | 18.04 | 19.44 | +7.79% |
| 8 | 160 | 3.5 | 0.8 × 0.8 | 18.72 | 18.78 | +0.29% |
| 9 | 165 | 3.9 | 0.75 × 0.5 | 18.57 | 18.28 | −1.56% |
| 10 | 170 | 3.8 | 0.65 × 0.45 | 18.87 | 18.23 | −3.36% |
| 11 | 176 | 3.4 | 0.7 × 0.5 | 17.84 | 17.66 | −1.01% |

+Scorching Test: Chlorinated fabrics were scorched at 185° C. for 30 seconds (AATCC Test Method 92-1974).

From the above data it is evident that the Textile Resin of Example 1 shows minimum or no loss in tensile strength due to retained chlorine after the bleaching process.

EXAMPLE 3

The Textile Resin of Example 1 was applied to swatches of a 50/50 polyester/cotton sheeting material (109 g/m$^2$) and cured. Dimethylol 4,5-dihydroxyethyleneurea (aqueous) solution (45% solids) was applied to and cured on control swatches of the same polyester/cotton sheeting material. In each case 12% of the specified crosslinking agent solution was added to an aqueous dispersion of 2% of a commercial non-ionic polyethylene emulsion (25% solids), 2% of a commercial non-ionic fatty blend liquid softener, 1.7% of the magnesium nitrate catalyst of Example 1 and 0.2% of the non-ionic wetting agent of Example 1, the balance of the bath being water. The wet pick-up was 60% in each case. The swatches were dried and cured at 205° C. for 20, 60 and 120 seconds.

The fabrics thus cured were tested for discoloration. Only those fabrics that had been cured for 20 seconds were tested essentially for durable press appearance, shrinkage (warp x fill), fabric free formaldehyde content and chlorine retention damage by the AATCC Test Methods described in Example 1. A summary of the results is reported in Table 5.

TABLE 5

| Properties | Curing Time [sec] | 12% Textile Resin (48% Aqueous Sol.) | 12% DMDHEU+ Crosslinking Agent (45% Sol.) |
|---|---|---|---|
| Whiteness | 20 | 124.9 | 121.0 |
| | 60 | 106.6 | 100.0 |
| | 120 | 93.4 | 82.3 |
| Durable Press | | | |

TABLE 5-continued

| Properties | Curing Time [sec] | 12% Textile Resin (48% Aqueous Sol.) | 12% DMDHEU+ Crosslinking Agent (45% Sol.) |
|---|---|---|---|
| Appearance (after 5 home washes) | 20 | 4.0 | 3.9 |
| % Shrinkage (W × F) (After 5 washes) | 20 | (1.2 × 0.8) | (1.1 × 0.8) |
| Fabric Free Formaldehyde Content [ppm] | 20 | 450 | 1028 |
| Chlorine Scorch | 20 | no discoloration | no discoloration |
| Resistance | | no chlorine damage | no chlorine damage |

+DMDHEU = Dimethylol-4,5-dihydroxyethyleneurea

It is clear from the above data that the Textile Resin of Example 1 gives satisfactory and in some respects excellent properties over the DMDHEU crosslinking agent.

We claim:

1. A process for finishing a cellulosic textile which has been pretreated with liquid ammonia, by impregnating the textile with a finishing agent based on an aminoplast intermediate and heating for from 10 seconds to 6 minutes at from 110° to 230° C. in the presence of an acid or latent acid catalyst, wherein the finishing agent employed is a water-soluble compound of the formula III

III

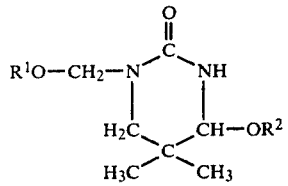

where $R^1$ and $R^2$ independently of one another are hydrogen, methyl, ethyl, propyl or methoxyethyl and $R^2$ may also be the radical of an ethylene oxide and/or propylene oxide polymer chain comprising from 1 to 20 monomer units.

2. A process as set forth in claim 1 wherein $R^1$ of the compound of the formula III is hydrogen and $R^2$ is a mixture of hydrogen and methyl.

* * * * *